US005469017A

United States Patent [19]

Perreaut et al.

[11] Patent Number: 5,469,017

[45] Date of Patent: Nov. 21, 1995

[54] PERMANENT MAGNET FOCUS UNIT WITH INTEGRAL ASTIGMATISM CORRECTOR

[75] Inventors: Jean M. Perreaut, Dijon; Bruno F. Roussel; Didier Thibaudin, both of Genlis, all of France

[73] Assignee: Thomson Tubes & Displays, S.A., Paris, France

[21] Appl. No.: 35,386

[22] Filed: Mar. 22, 1993

[30] Foreign Application Priority Data

Mar. 27, 1992 [EP] European Pat. Off. ..... 92400871

[51] Int. Cl.[6] ..... H01J 29/70

[52] U.S. Cl. ..... 313/431; 313/440; 313/421; 313/442; 335/210; 335/213

[58] Field of Search ..... 313/440, 431, 313/421, 442; 335/210, 213

[56] References Cited

U.S. PATENT DOCUMENTS

| | | | |
|---|---|---|---|
| 2,372,443 | 4/1942 | Marton | 313/442 |
| 2,431,077 | 11/1947 | Poch | 313/431 |
| 2,718,606 | 9/1955 | Zuerker | 335/210 |
| 2,729,748 | 1/1956 | Robinson | 313/431 |
| 2,822,528 | 4/1958 | Janssen | 313/431 |
| 3,230,415 | 8/1962 | Kratochvil et al. | 313/442 |
| 3,296,570 | 1/1967 | Uetake | 313/431 |
| 3,371,206 | 2/1965 | Kakizawa | 313/431 |
| 4,642,527 | 2/1987 | Takahashi et al. | 313/431 |
| 4,714,908 | 12/1987 | Watabe | 335/212 |
| 4,758,762 | 7/1988 | Van Gorkum et al. | 313/440 |
| 4,758,813 | 7/1988 | Holsinger | 335/306 |
| 4,896,071 | 1/1990 | Pons | 313/428 |
| 5,113,162 | 5/1992 | Umehara | 335/210 |
| 5,124,613 | 6/1992 | Park | 313/440 |

FOREIGN PATENT DOCUMENTS

| | | | |
|---|---|---|---|
| 0249294 | 12/1987 | European Pat. Off. . | |
| 758547 | of 1953 | Germany . | |
| 55-155448 | 12/1980 | Japan | 313/431 |
| 2085698 | 4/1982 | United Kingdom . | |

*Primary Examiner*—Sandra L. O'Shea
*Assistant Examiner*—Matthew J. Esserman
*Attorney, Agent, or Firm*—Joseph S. Tripoli; Joseph L. Laks; Harvey D. Fried

[57] ABSTRACT

A focusing unit for a cathode ray tube comprises a plurality of permanent magnets, each having a longitudinal axis, and a plurality of coils. A form holds the magnets in a first annular array at substantially equally spaced intervals in which the magnet axes are substantially parallel to a longitudinal axis defined by the first annular array and holds the coils in a second annular array at positions spaced angularly between the magnets. Annular flanges of high magnetic permeability are disposed over longitudinally opposite ends of the magnets. At least one annular winding is disposed substantially adjacent to and inwardly from the first array of the magnets. In one embodiment, the coils are helical coils disposed in substantial circumferential alignment with the first annular array of the magnets. The helical coils each having a substantially is radially aligned longitudinal axis. In another embodiment, the plurality of coils are spaced radially between the first array of the magnets and the at least one annular winding. Each of these coils defines a substantially radially aligned longitudinal axis. In each embodiment, the plurality of coils of the second array are coupled in two interleaved sets for generating two quadripole focusing fields for correcting astigmatic aberrations of an electron beam in the cathode ray tube.

19 Claims, 4 Drawing Sheets

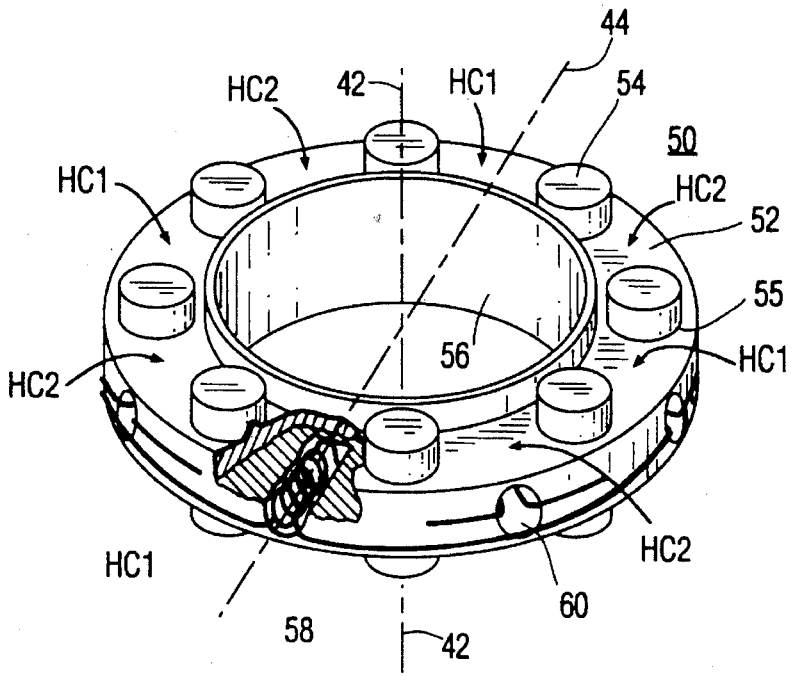
FIG. 8
FIG. 9
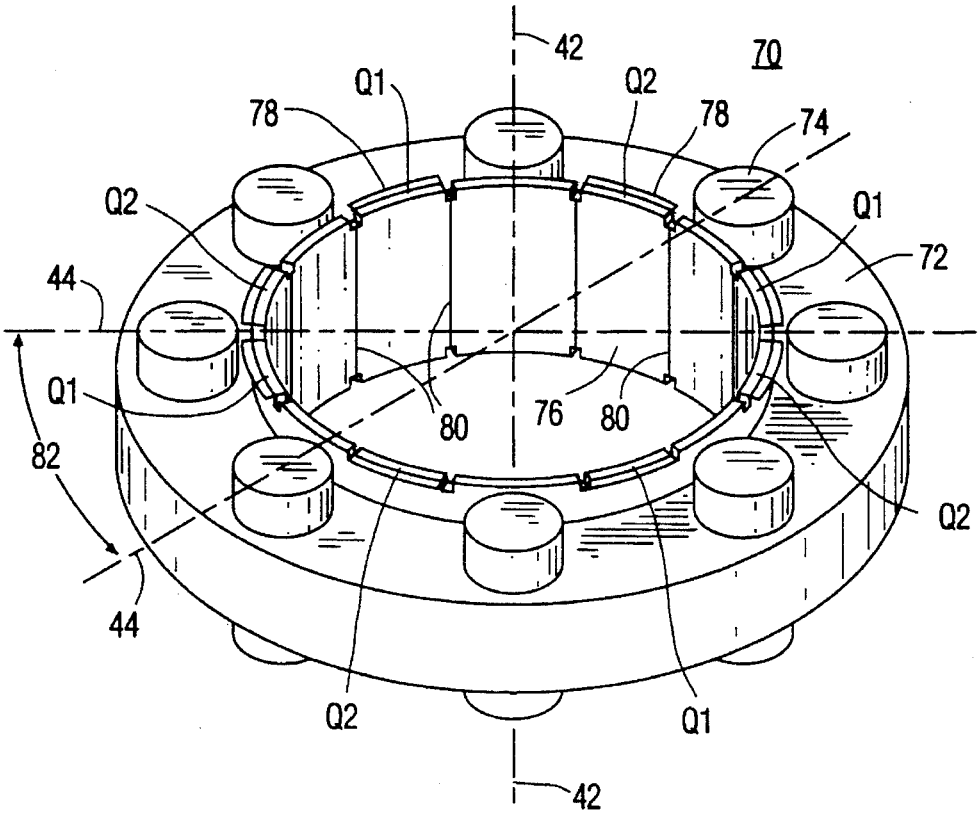

PERMANENT MAGNET FOCUS UNIT WITH INTEGRAL ASTIGMATISM CORRECTOR

BACKGROUND OF THE INVENTION

1. Field of the Invention

This invention relates to the field of focusing electron beams in cathode ray tubes, and in particular, to a permanent magnet focus unit for a cathode ray tube having an astigmatism corrector assembled integrally therewith.

2. Description of Related Art

A typical cathode ray tube 2 shown in FIG. 1 has an electron gun 4 for generating an electron beam 6 which strikes a screen 8 of the cathode ray tube. The electron beam is deflected for generating a raster by a deflection yoke 10. The electron beam is focused by a focus coil or assembly 12 which generates a magnetic focus field 16, shown in FIG. 2.

The magnetic field 16 can be produced by an annular wound coil, a toroidal permanent magnet, an array of permanent magnets, or a combination thereof, which alone or together generate a coaxial magnetic field. The magnetic field acts as a lens for the electron beam. This lens tends to have the same aberrations as would a lens for light rays, for example astigmatism.

It is possible to correct astigmatism of the electron beam by the way of additional coils which are generally denoted astigmatism correctors. The necessary magnetic field is generally produced by four windings coupled to have alternately North and South magnetic poles. It is possible to correct horizontal or vertical beam astigmatism by changing the current direction in the winding. Diagonal coils can be used in a similar fashion to correct the diagonal astigmatism. Axial and diagonal astigmatism correction are illustrated in FIGS. 3 and 4 respectfully The currents in the windings exert forces (F). The correctors are designed as quadripolar lenses for effecting axial and diagonal astigmatic corrections, as shown in FIGS. 5 and 6 respectively.

Generally, the astigmatism corrector is designed as a winding in a separate unit or assembly positioned at the outlet of the electron gun, as shown in FIG. 1. This arrangement entails several disadvantages. Firstly, the sensitivity is generally low because of the small beam diameter at the outlet of the electron gun. Secondly, this technology is generally used to correct the electron gun astigmatism. When such a corrector is combined with a magnetic focus coil, the astigmatism correction is not easy to obtain because of the beam rotation imparted by the focus coil. Thirdly, the cost of such a solution can be significant due to the need for designing and manufacturing a separate unit or assembly.

SUMMARY OF THE INVENTION

In accordance with an inventive arrangement, it has been determined that it is possible to integrate a focusing unit and an astigmatism corrector into the same assembly, when the focusing unit utilizes a plurality of separate magnets disposed in an annular array. An annular form or holder positions a plurality of separate magnets in an annular array. A small coil is wound around each magnet for magnetizing the magnets in a uniform fashion prior to use. The magnets are cylindrical in form, and each has a longitudinal axis substantially parallel with the central axis of the focusing unit. An auxiliary winding for generating a part of the magnetic focusing field is disposed radially inwardly of the array of permanent magnets. Flat annular flanges of a material having a high magnetic permeability cover the ends of the magnets on each side. The use of separate magnets disposed in an array provides an opportunity to position windings for correcting astigmatic aberrations directly on the form or holder of the focusing unit, as part of an integral assembly.

In one embodiment, windings for correcting astigmatic aberrations, in the form of helical coils having radially aligned axes, can be placed in the form or holder, one between each of the permanent magnets. In another embodiment, windings for correcting astigmatic aberrations, in the form of flattened coils, can be mounted in slots in an inwardly facing surface of the form or holder, at positions which are radially between the array of permanent magnets and the auxiliary winding, and which at the same time, are angularly between the circumferential positions of the permanent magnets. In either case, eight such windings can be divided into two groups of four windings each, with the windings of each group alternating in position. The windings of each group are coupled to generate a magnetic field, orthogonal to the electron beam. Together, the windings form a double quadripole lens able to correct the axial and diagonal astigmatism.

The inventive arrangement has a number of advantages. The integrated astigmatism assembly has better sensitivity because the corrector is placed at the point of maximum beam diameter. The problem of beam rotation affecting the astigmatism correction is eliminated. The focusing unit can be easily adjusted by applying a sinusoidal signal to the astigmatism coils. The cost of manufacture is reduced because a separate astigmatism corrector unit need not be designed of built. The quadripolar coils of conventional astigmatism correctors have to be wound on ferrite cores to increase the sensitivity and to permit high frequency dynamic signals. Due to the low coupling with metal parts and the better sensitivity, it is possible to use windings without a core. This is results in a very good behavior at high frequencies.

BRIEF DESCRIPTION OF THE DRAWINGS

FIG. 8 is a perspective view, partially broken away, of an integrated focusing unit and astigmatism corrector according to a first embodiment.

FIG. 9 is a perspective view of an integrated focusing unit and astigmatism corrector according to a second embodiment.

FIG. 11(*b*) illustrates a current amplifier coupled to a diagonal correction coil.

DETAILED DESCRIPTION OF THE PREFERRED EMBODIMENTS

Figure 1:
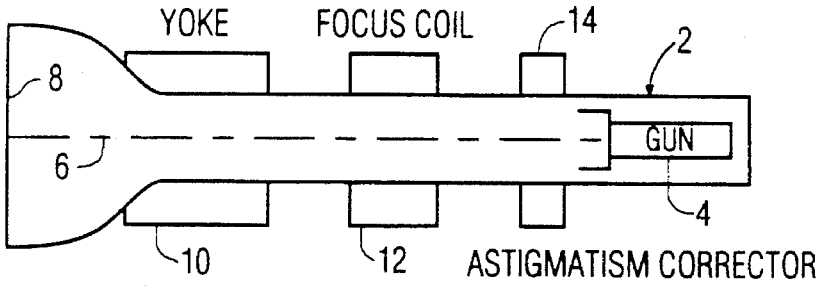
FIG. 1 is a diagram of a conventional cathode ray tube and the various coils and windings mounted thereon.
Figure 2:
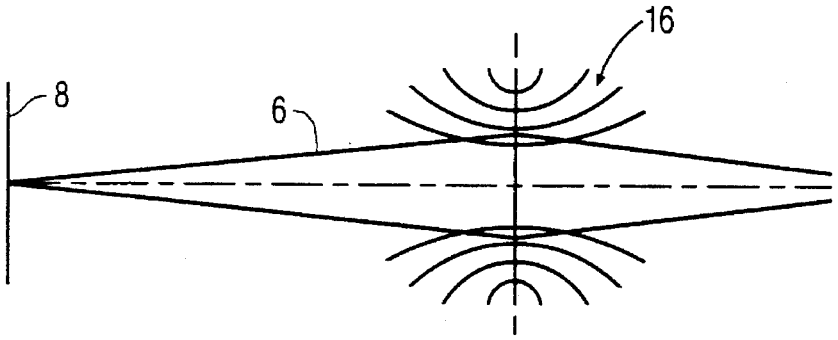
FIG. 2 is a diagram useful for explaining how an electron beam is affected by a focusing unit.
Figure 3:
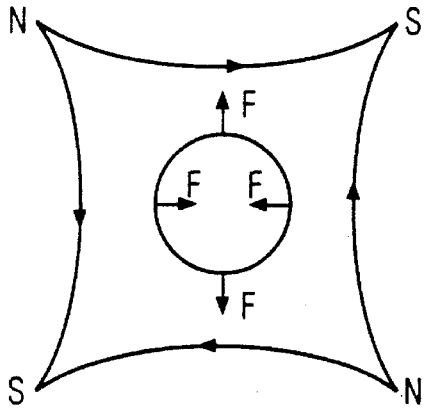
FIG. 3 is a diagram useful for explaining axial astigmatic correction.
Figure 4:
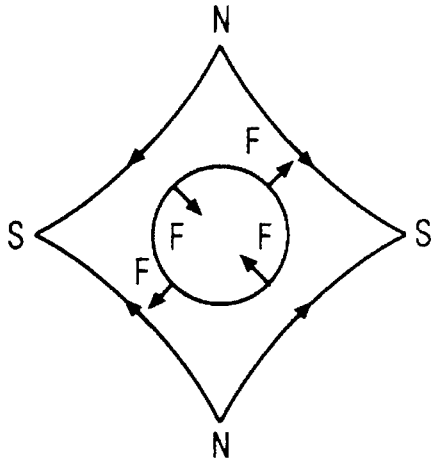
FIG. 4 is a diagram useful for explaining diagonal astigmatic correction.
Figure 5:
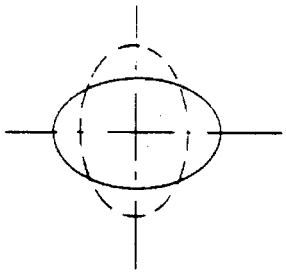
FIG. 5 is a diagram illustrating a field for correcting axial astigmatic aberrations.
Figure 6:
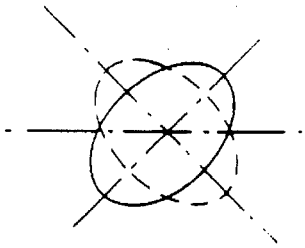
FIG. 6 is a diagram illustrating a field for correcting diagonal astigmatic aberrations.
Figure 7:
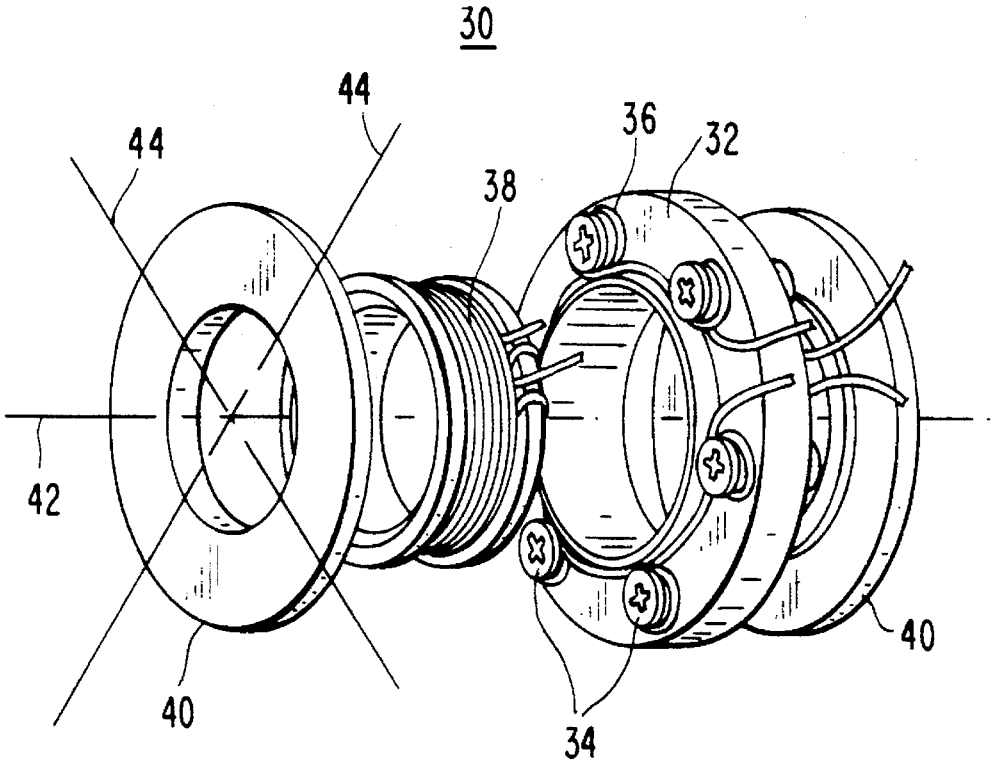
FIG. 7 is an exploded view, in perspective, of a focusing unit having an array of permanent magnets.

A focusing unit utilizing a plurality of separate magnets is explained in connection with the focusing unit 30 shown in FIG. 7. An annular form or holder 32 holds a plurality of separate magnets 34 in an annular array. A small coil 36 is wound helically around each magnet for magnetizing the magnets in a uniform fashion prior to use. The magnets are cylindrical in form, and each has a longitudinal axis substantially parallel with the central longitudinal axis 42 of the focusing unit 30. The geometry of the annular unit further defines a plurality of radii 44, two of which are illustrated. These provide a basis for defining relatively inward and outward radial positions, inwardly being in the direction of the central axis 42. These directional conventions are used in connection with FIGS. 8 and 9 as well. In this regard, an auxiliary winding 38 for generating a part of the magnetic focusing field is disposed radially inwardly of the array of permanent magnets 34. Flat annular flanges 40 of a material having a high magnetic permeability cover the ends of the magnets on each side. The use of separate magnets disposed in an array provides an opportunity to position windings for correcting astigmatic aberrations directly on the form or holder of the focusing unit, as part of an integral assembly. Two embodiments of such an integral focusing unit or assembly are shown in FIGS. 8 and 9 respectively.

Focusing unit 50 shown in FIG. 8 has a geometry defining a central longitudinal axis 42 and a plurality of radii 44. Unit 50 comprises an annular form or holder 52 holding a plurality of permanent magnets 54 in respective bores 55 in an annular array. Magnetizing windings for the magnets are omitted. Eight magnets 54 are provided, in order to provide eight positions between the magnets for receiving eight astigmatism correcting windings. Each winding is in the form of a helical coil 58 disposed in a bore 60. The helical coils and bores have longitudinal axes which are substantially radially aligned. The positions between the magnets are alternately labelled HC1 and HC2. A helical coil 58 is positioned beneath (in the sense of the FIGURE) each label. The four helical coils in the HC1 positions are coupled together to generate a first quadripole field. The four helical coils in the HC2 positions are coupled together to generate a second quadripole field. The two sets of helical coils are rotationally offset from one another by 90°, and accordingly, the two quadripole magnetic fields will be rotationally offset from one another by 90°. Both axial and diagonal astigmatic aberrations can therefore be corrected. The form 52 has an inwardly facing surface 56, which in this embodiment is unbroken. An auxiliary winding corresponding to auxiliary winding 38 shown in FIG. 7 and flanges corresponding to flanges 40 shown in FIG. 7 are also omitted for purposes of clarity.

Focusing unit 70 shown in FIG. 9 has a geometry defining a central longitudinal axis 42 and a plurality of radii 44. Unit 70 comprises an annular form or holder 72 holding a plurality of permanent magnets 74 in an annular array. Magnetizing windings for the magnets are omitted. Eight magnets 74 are provided, in order to provide eight positions angularly spaced between the magnets for receiving eight astigmatism correcting windings. Each winding is in the form of a flattened coil 78. The form 72 has an inwardly facing surface 76, which unlike the corresponding surface 56 shown in FIG. 8, has a plurality of longitudinal slots 80 formed therein. Radii 44 through adjacent magnets 74 define intermediate sectors 82. Each flattened coil 78 lies in one of the intermediate sectors 82. The positions between the magnets in these sectors are alternately labelled Q1 and Q2. Each sector is spaced apart by an interval corresponding to the circumferential position of each magnet 74. The four flattened coils in the Q1 positions are coupled together to generate a first quadripole field. The four flattened coils in the Q2 positions are coupled together to generate a second quadripole field. The two sets of flattened coils are rotationally offset from one another by 90°, and accordingly, the two quadripole magnetic fields will be rotationally offset from one another by 90°. Both axial and diagonal astigmatic aberrations can therefore be corrected. An auxiliary winding corresponding to auxiliary winding 38 shown in FIG. 7 and flanges corresponding to flanges 40 shown in FIG. 7 are also omitted for purposes of clarity. The embodiment of FIG. 9 is believed to provide better sensitivity than the embodiment of FIG. 8.

Figure 10:
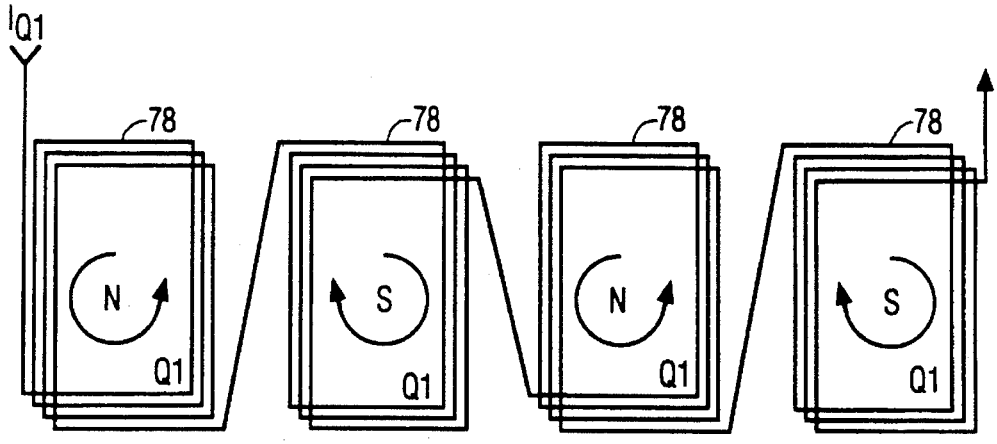
FIG. 10 is a diagram illustrating the manner in which a group of astigmatism corrective windings can be coupled for generating a quadripole field.

The Q1 set of flattened coils 78 as coupled for generating a quadripole field are shown in FIG. 10. Each flattened coil comprises several loops. The direction of current flow alternates from one coil to the next, generating alternating North (N) and South (S) poles. The Q2 set of flattened coils is coupled in a similar fashion. The helical coils of the HC1 and HC2 sets of windings in the embodiment shown in FIG. 8 are also respectively coupled in a similar fashion to generate alternating North South fields.

Figure 11A:
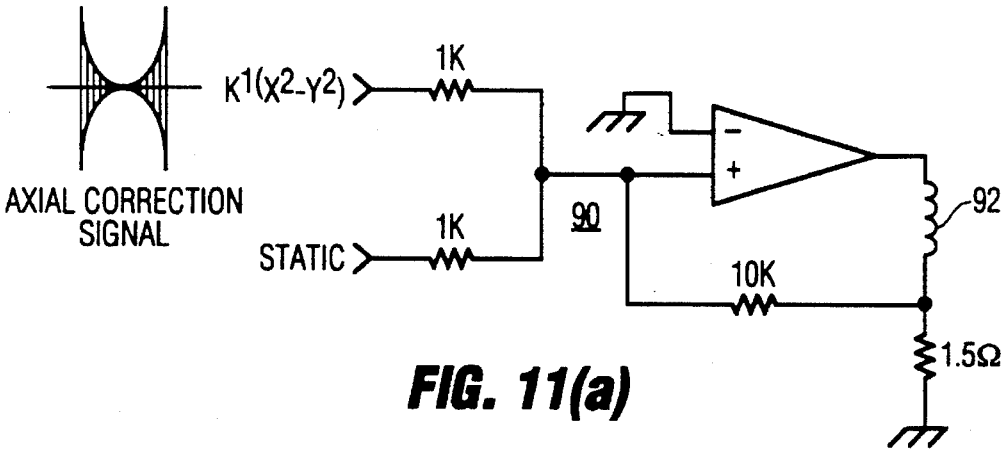
FIG. 11(*a*) illustrates a current amplifier coupled to an axial correction coil.
Figure 11B:
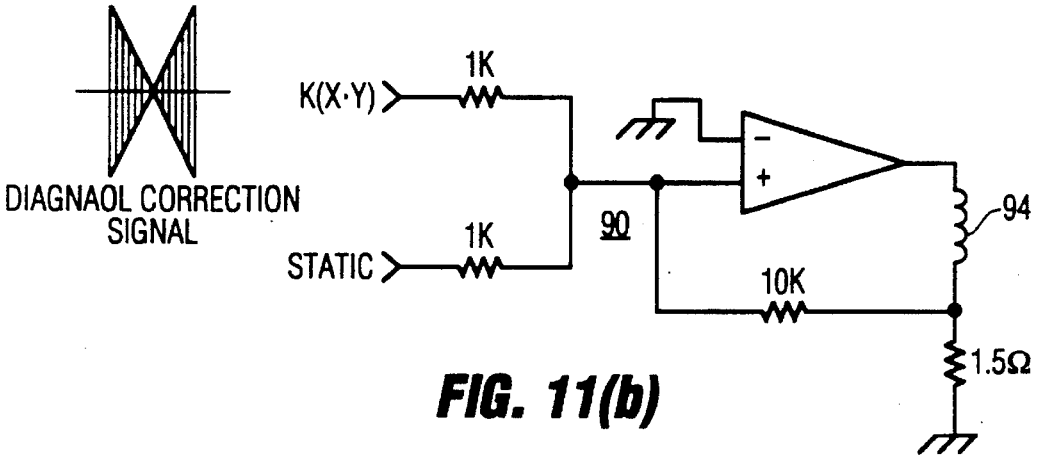

The same current amplifier can be used for generating the current for driving each of the sets of coils (HC1, HC2; Q1, Q2). A current amplifier 90 is shown in FIG. 11(*a*) coupled to an axial correction coil 92 and a current amplifier 90 coupled to a diagonal correction coil 94 is shown in FIG. 11(*b*). Amplifier 90 is both a static and dynamic current amplifier. The static current input corrects the natural beam astigmatism and the dynamic current input corrects the astigmatism at the edges of the screen. Axial and diagonal astigmatism can be corrected by currents according to the following formulas, respectively:

$$I_{AXIAL}=K'(X^2-Y^2)$$

$$I_{DIAGONAL}=K(X\cdot Y).$$

Appropriate waveforms for the dynamic component of the current input for axial and diagonal correction respectfully are also illustrated in FIGS. 11(*a*) and 11(*b*).

What is claimed is:

1. An apparatus, comprising:

an annular form adapted for mounting on a neck of a cathode ray tube in which an electron beam is established;

a plurality of permanent magnets disposed on said form for generating a first field for focusing said electron beam, each of said permanent magnets having a longitudinal axis substantially parallel to said electron beam;

an annular winding disposed on said form for generating a second field for focusing said electron beam, said annular winding having a longitudinal axis substantially parallel to said electron beam; and, a plurality of windings disposed on said form in an annular array and coupled for generating a third field for correcting astigmatic aberrations in said electron beam, each of said plurality of windings having a longitudinal axis substantially perpendicular to said electron beam.

2. The apparatus of claim 1, wherein said plurality of windings are positioned and coupled for generating a quadripole field.

3. The apparatus of claim 1, wherein said plurality of windings are coupled for generating said third field and a fourth field for correcting different astigmatic aberrations.

4. The apparatus of claim 1, wherein said plurality of windings are positioned and coupled for generating said third field as a first quadripole field and generating a fourth field as a second quadripole field.

5. The apparatus of claim 1, wherein said plurality of windings generating said third field are radially positioned between said permanent magnetic means and said annular winding.

6. The apparatus of claim 1, wherein said annular form comprises an inwardly facing surface having a plurality of slots formed therein for receiving said plurality of windings generating said third field.

7. The apparatus of claim 1, wherein a first group of said plurality of windings are coupled for generating said third field for correcting a first type of said astigmatic aberrations and a second group of said plurality of windings are coupled for generating a fourth field for correcting a second type of said astigmatic aberrations; and, said annular form comprises an inwardly facing surface having a plurality of slots formed therein for receiving both said groups of said plurality of windings in an alternating pattern.

8. The apparatus of claim 1, wherein said annular form has a plurality of substantially radially aligned bores disposed at spaced intervals for receiving respective ones of said plurality of windings generating said third field.

9. The apparatus of claim 1, wherein each of said plurality of windings generating said third field is a substantially helical coil.

10. The apparatus of claim 1, wherein each of said plurality of windings generating said third field is a substantially helical coil and said form has a plurality of bores at spaced intervals for receiving respective ones of said helical coils.

11. The apparatus of claim 1, wherein said form has two sets of bores disposed alternately in annular arrays, each of said bores of one of said sets having disposed therein one of said windings generating said third field and each of said bores of the other one of said sets having one of said permanent magnet disposed therein.

12. The apparatus of claim 1, wherein said form has two sets of bores disposed alternately in annular arrays, each of said bores of one of said sets having disposed therein one of said windings generating said third field and each of said bores of the other one of said sets having one of said permanent magnet disposed therein, said bores of said respective sets having mutually perpendicular longitudinal axes.

13. A focusing unit for a cathode ray tube, comprising:

a plurality of permanent magnets, each having a longitudinal axis;

a plurality of coils;

means for holding said magnets in a first annular array at substantially equally spaced intervals in which said magnet axes are substantially parallel to a longitudinal axis defined by said first annular array and for holding said coils in a second annular array at positions spaced angularly between said magnets;

annular flanges of high magnetic permeability disposed over longitudinally opposite ends of said magnets; and, at least one annular winding disposed substantially adjacent to and inwardly from said first array of said magnets.

14. The apparatus of claim 13, wherein said second annular array of said coils is disposed in substantial circumferential alignment with said first annular array of said magnets.

15. The apparatus of claim 14, wherein said plurality of coils of said second annular array are helical coils, each having a substantially radially aligned longitudinal axis.

16. The apparatus of claim 14, wherein said plurality of coils of said second array are coupled in two interleaved sets for generating two quadripole focusing fields for correcting astigmatic aberrations of an electron beam in said cathode ray tube.

17. The apparatus of claim 13, wherein said plurality of coils are spaced radially between said first array of said magnets and said at least one annular winding.

18. The apparatus of claim 17, wherein each of said coils defines a substantially radially aligned longitudinal axis.

19. The apparatus of claim 18, wherein said plurality of coils of said second array are coupled in two interleaved sets for generating two quadripole focusing fields for correcting astigmatic aberrations of an electron beam in said cathode ray tube.

* * * * *